United States Patent [19]

Kirley

[11] 4,413,756

[45] Nov. 8, 1983

[54] AEROSOL INSECT EXTERMINATOR DEVICE

[76] Inventor: Joseph F. Kirley, 138 Crescent Rd., Concord, Mass. 01742

[21] Appl. No.: 971,394

[22] Filed: Dec. 20, 1978

[51] Int. Cl.[3] ..... B65D 83/14; B05B 9/03

[52] U.S. Cl. ..... 222/402.11; 222/402.15; 222/538; 251/89.5; 43/132.1

[58] Field of Search ..... 222/402.11, 402.15, 222/538, 567, 568, 575; 128/184, 249, 303.1, 399, 400, 402; 251/89, 89.5; 43/132 A, 132 R, 132.1; 239/288.5, 390, 391

[56] References Cited

U.S. PATENT DOCUMENTS

| | | | |
|---|---|---|---|
| 2,821,048 | 1/1958 | Efford et al. | 222/402.13 X |
| 2,985,382 | 5/1961 | Coplan | 222/402.11 X |
| 3,209,751 | 10/1965 | Wakeman | 222/402.12 X |
| 3,247,849 | 4/1966 | Wise et al. | 128/249 X |
| 3,306,252 | 2/1967 | Knight et al. | 222/402.11 X |
| 3,601,290 | 8/1971 | Nigro | 222/402.11 |
| 3,865,283 | 2/1975 | Hayes | 222/402.11 |

FOREIGN PATENT DOCUMENTS

| | | | |
|---|---|---|---|
| 967950 | 8/1964 | United Kingdom | 222/402.11 |

*Primary Examiner*—David A. Scherbel

*Attorney, Agent, or Firm*—Alfred E. Miller

[57] ABSTRACT

A device for instantaneous, non-poisonous extermination of insects by means of an aerosol assembly having a cap enclosure removably secured to the aerosol nozzle for trapping an insect. The propellent in the aerosol can, upon release in the cap enclosure, expands suddenly to form an extremely cold gas that instantaneously freezes any insect trapped in said cap enclosure. The valve assembly and cap enclosure can be selectively turned to permit the extinction of insects on floors, walls, and ceilings. A child safety device is utilized which permits actuation of the valve only when the assembly is in a certain position. A further safety device is provided to prevent the discharge of the contents thereof only when the cap is pressed against a firm surface.

4 Claims, 12 Drawing Figures

Fig. 10.
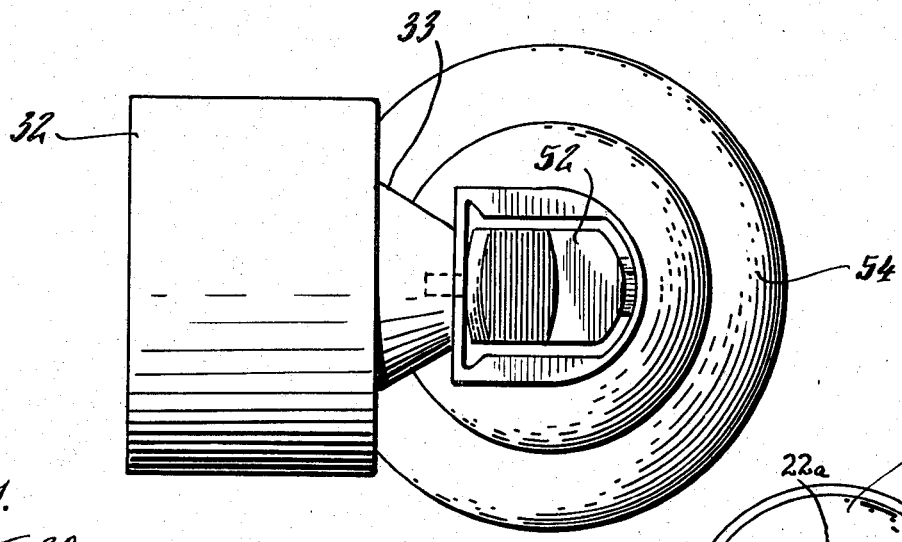
Fig. 11.
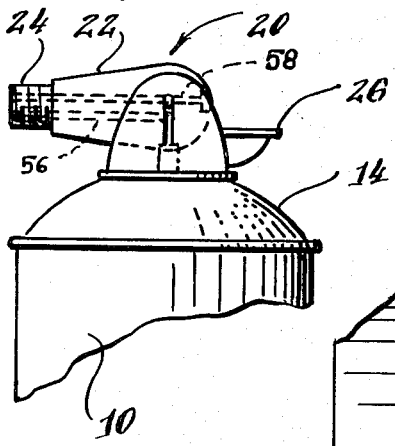
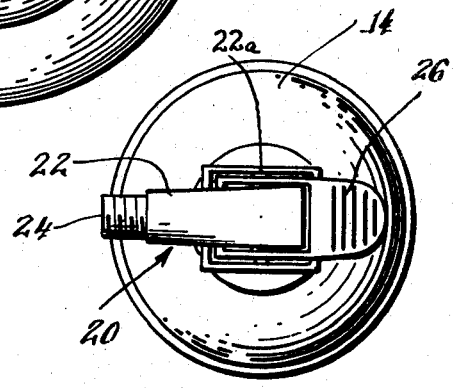
Fig. 12.
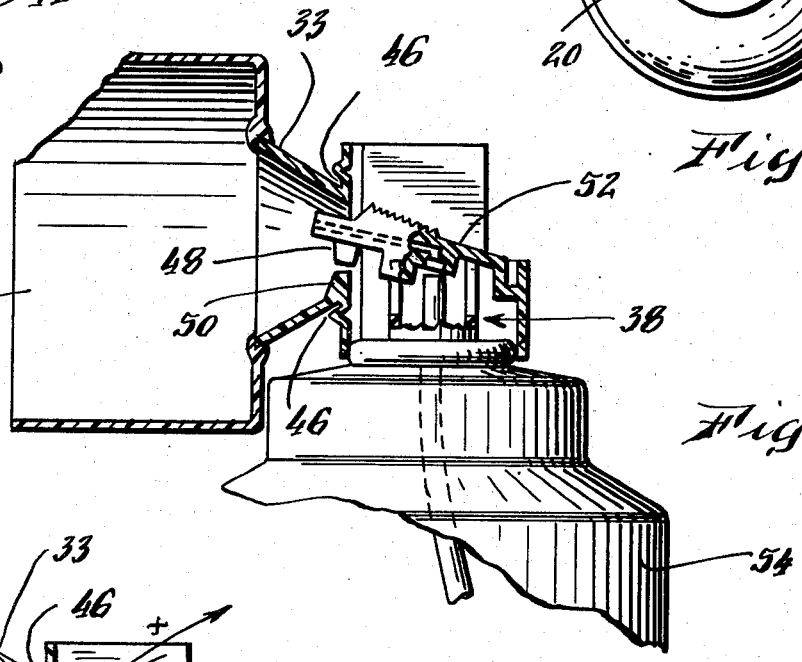
Fig. 8.
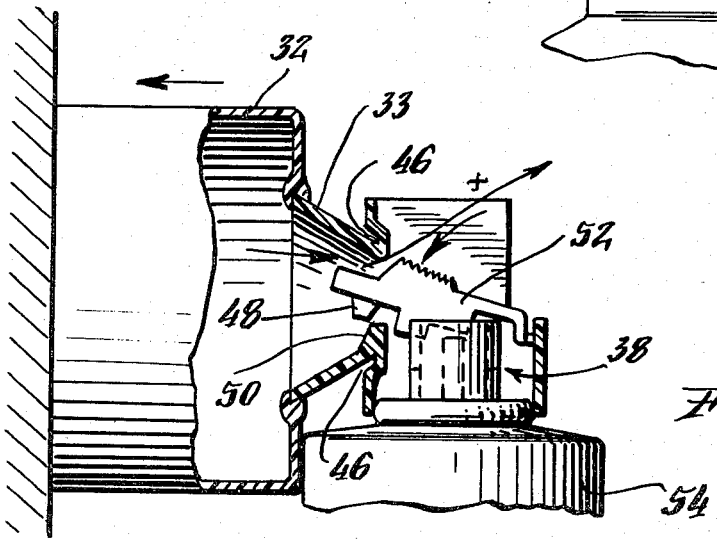
Fig. 9.

AEROSOL INSECT EXTERMINATOR DEVICE

BACKGROUND OF THE INVENTION

It is known to eliminate insects by means of an aerosol spray. However, these sprays are ejected into the atmosphere and there is no means of structure for containing the spray within a confined area. It is also well known that some of these sprays are hazardous to the health and safety of the general public in that they contain poisonous gaseous elements. Furthermore, the spray odor is particularly disagreeable and there is no means for containing the unsightly remains of dead insects so that they can be properly disposed of. In addition, the use of poisonous aerosol devices is continually under the scrutiny of governmental bodies because of the above-mentioned hazards. In addition, it is to be noted that recent government regulations have been adopted with respect to closures for cans and bottled containing potentially dangerous substances to children.

The present invention relates to a non-poisonous aerosol insect exterminator which has child saftey capability and can be used effectively on walls, floors, and ceilings.

It is an object of the present invention to provide an efficient method for eliminating insects indoors without the concomitant hazards of the use of a poisonous spray and to provide an enclosure which is removably attached to the aerosol device for both trapping the insect and forming an enclosure for the ejected spray therein.

It is another object of the present invention to provide an aerosol insect exterminator device in which the method of extermination is by sudden freezing of the insect.

It is an object of the present invention to provide a device for eliminating insects in which no odor or oily residue are left by the spray, and the unsightly remains of dead insects can be easily and quickly disposed of.

It is another object of the present invention to provide a safety element to be utilized in connection with the aerosol insect eliminator that permits the aerosol device to be operated only when the valve assembly is aligned with indicator means on the aerosol can, indicating the ceiling or wall, and floor or wall positions thereof.

In order that the invention will be more clearly understood, it will now be disclosed in greater detail with reference to the accompanying drawings, in which.

FIGS. 8 and 9 each show a view partly in elevation, and partly in section of a further embodiment of the present invention;

FIG. 10 is a top plan view of the structure shown in FIG. 8;

FIG. 11 is a side elevation view of the swivel valve arrangement of the present insect exterminator device; and FIG. 12 is a top plan view of the structure shown in FIG. 11.

DESCRIPTION OF THE PREFERRED EMBODIMENTS

Figure 1:
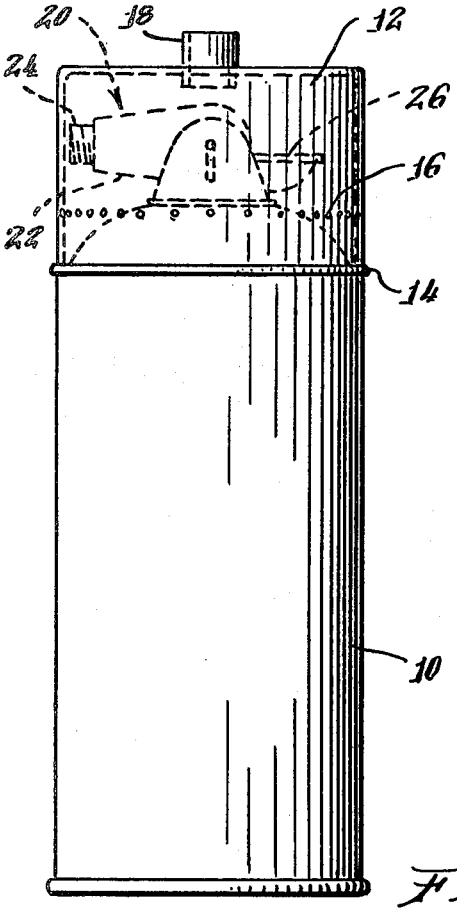
FIG. 1 is a side elevational view of the aerosol insect exterminator device is constructed in accordance with the teachings of my invention.
Figure 2:
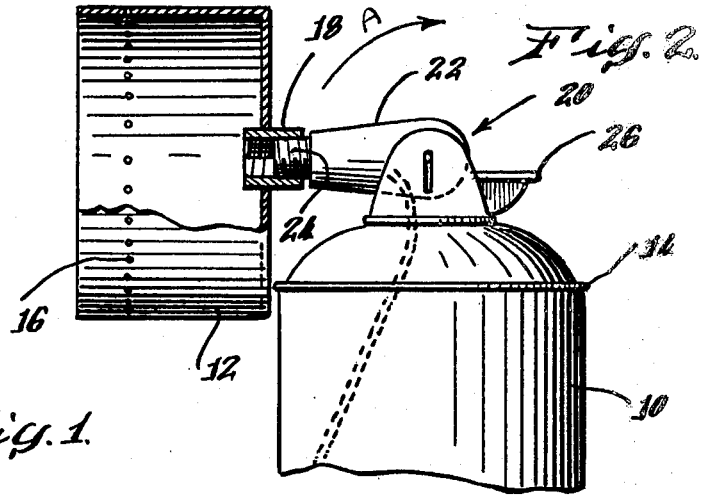
FIG. 2 is a view similar to that of FIG. 1 with the cap removed and secured by threaded connectors to the orifice of the aerosol can.

Referring to FIGS. 1 and 2, an aerosol can 10 is shown that is filled with a compressed liquid propellent of the non-poisonous type, which upon release, expands suddenly to form an extremely cold gas, such as $CO_2$, which functions to freeze an insect, thus either stunning it with a light dosage or killing it with a larger dosage. A cap 12 fabricated of a transparent plastic material is provided with an open end, said cap 12 fitting over the circumferential rim 14 of the aerosol can. The cap is provided with a plurality of vent holes 16 arranged around the circumference thereof and an internally threaded hollow connector 18 located centrally in the closed end of the cap 12. The nozzle assembly for the aerosol can is referred to generally by the numeral 20 and includes a spout 22 with a hollow threaded connector 24 on the front end thereof forming a separable discharge orifice. A valve lever 26 is shown for actuating the valve mechanism in order to expel the propellant from the interior of the can 10 to the atmosphere. As seen in FIG. 2, the cap 12 is shown affixed to the aerosol can 10 by means of mating threaded connectors 18 and 24. The spout 22 is so constructed and designed to pivot upwardly, as shown by the arrow A, when it is desired to trap and exterminate an insect on a ceiling surface.

If the insect to be exterminated is on a wall, or other vertical surface, the cap 12 forms a relatively large enclosure, as seen in FIG. 2, in which to trap the insect. The procedure is to press the cap against the wall thereby trapping the insect. Thereafter, the valve lever 26 is depressed, releasing some of the pressurized liquid propellent from the can 10. The propellent, upon sudden expansion, forms a very cold gas, thus immediately freezing the insect which falls onto an inner surface of the cap 12. By tilting the can 10, the dead insect will be retained in the cap receptacle, which permits the insect remains to be easily disposed of, without manually contacting the same. The vent holes 16 prevent a pressure build up within the cap with its concomitant hazards.

If the insect appears on the ceiling, then the cap together with valve assembly can be swivelled in an upwardly direction as mentioned hereinbefore, and sufficient liquid propellent released in order to stun or exterminate the insect on the ceiling. This can be easily accomplished inasmuch as the spout 22 is spring mounted, so that if one grasps the bottom of an aerosol can, preferably of an elongated type, and holds it vertically, and presses the same against the ceiling surface, the propellent is released since a portion of the spout 22 engages the valve lever or finger-actuated member 26 to thereby release the propellent from the can 10. This particular feature provides the user with an extended reach for use of the device on ceilings without elevating oneself by means of a ladder, or the like.

Figure 5:
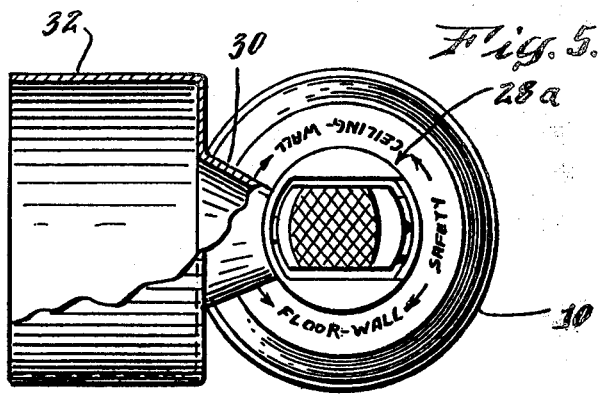
FIG. 5 is a top plan view of the device as shown in FIG. 3. showing the various indicia on the aerosol can which can be selectively aligned with a mark on an exterior surface of the rotatable valve assembly.
Figure 3:
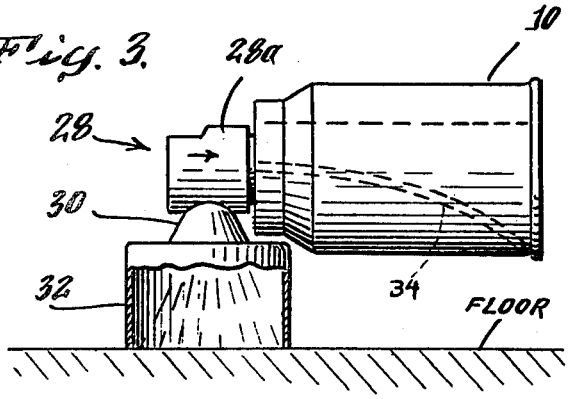
FIG. 3 is a side elevational view of another embodiment of the aerosol insect exterminator device shown in FIG. 1 in the floor position thereof.
Figure 4:
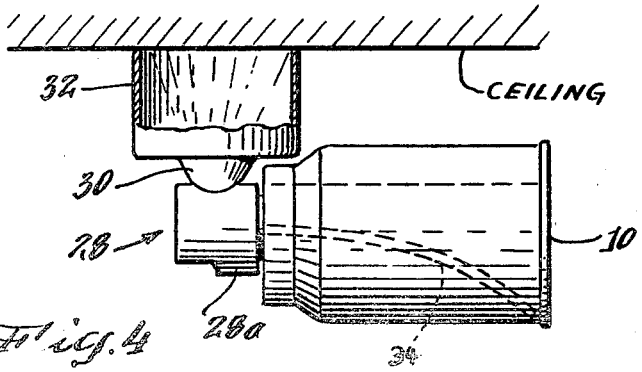
FIG. 4 is a view of the device shown in FIG. 3 in the ceiling position thereof.

Another embodiment of the present invention, which is a desirable configuration, is shown in FIGS. 3–5. The aerosol can 10 is provided with a valve assembly referred to generally by the number 28 which has a conical spout part 30 and a cylindrical cap 32 that is removably affixed to the conical part 30. As seen in FIG. 5, the upper shoulder 34 of the aerosol can 10 is provided with indicia, such as "ceiling or wall", "floor or wall", ahd "safety". Engraved on the side wall 28*a* of the valve assembly is an indicating mark which can be aligned with any of the indicia mentioned hereinabove, (FIG. 5) since the entire valve assembly can rotate in either direction as shown by the double-ended arrow in FIG. 5. It will be noted from FIGS. 4–5 that the supply or dip tube 34 will be in the proper position in which the end thereof is deeply submerged in the liquid propellent in the can 10 so that the spray will be released under pressure each time the valve or finger-actuated member 26 of the valve assembly is depressed. In this regard, FIG. 3 shows the "floor or wall" position of the can 10, while FIG. 4 shows the "ceiling or wall" position of the same can. It will be apparent that this construction eliminates the need for a swivel arrangement for the valve assembly as illustrated in FIG. 2 of the drawings.

Figure 6:
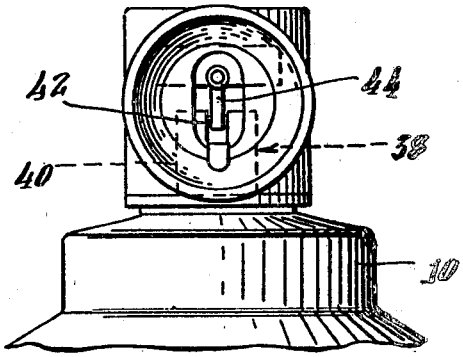
FIG. 6 is an elevational view of the construction with the cylindrical cap removed showing a fitting inserted into the valve assembly to that the latter can only be activated when the device is in the ceiling or wall, and floor or wall positions.
Figure 7:
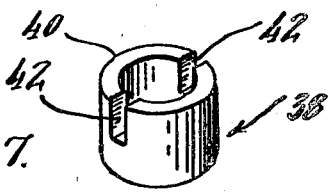
FIG. 7 is a perspective view of the fitting above.

Referring to FIGS. 6 and 7 in which is shown a fitting for the valve assembly, referred to generally by the number 38 and having a valve actuator bar 44, the fitting is in the form of a ring 40, having diametrically opposite slots 42. The ring 40 fits within the valve actuator with the slots 42 aligned with the "ceiling or wall" and "floor or wall" marks. Thus, the valve lever can only be depressed if there is an alignment with either marks for the "ceiling or wall" or "floor or wall" positions and cannot be depressed if the arrow on the valve assembly is aligned with the "safety" indicia. This is so because the valve actuator bar 44 can only enter aligned slots 42 when the valve assembly arrow is aligned with the aforesaid marks, thereby permitting the depression of the valve lever and releasing the liquid propellent in the can 10. This feature is a child safety means, so that normally a child cannot directly spray himself or another child with the contents of the aerosol can 10.

An embodiment of the present invention is shown in FIGS. 8–10 and relates to a fire safety means for an aerosol can 10. The means shown in FIGS. 8–10 also functions as a safety feature that is relevant to children as well as adults.

It is known that recently a ban on the use of fluorocarbons as a propellant in aerosol cans is in effect. Presently, flammable propellents are used instead of fluorocarbons. However, if these flammable propellents come in contact in an open area where a cigarette is being smoked, or a lit candle is in use, a danger of fire and explosion ensues. The present safety feature prevents discharge from the aerosol can unless the cap 32 is pressed against a firm surface. As seen in FIG. 8, the cap 32 is provided with a cone 33 having a circular diaphragm-like hinge 46. When the cone and its diaphragm 46 is in the rest position, the cone portion projects away from the body 54 of the can. The stops 48 and 50 are mounted on the valve lever 52 and the body portion 54 respectively. In the rest condition, the stops are aligned and therefore engage each other if the valve lever 52 is attempted to be pushed downwardly and the valve lever is then prevented from being pressed down. Thus, discharge of the contents of the aerosol can is not permitted unless, and only if, the cap is pressed against a firm surface. When this occurs, the cone portion is forced inwardly toward the body due to the natural flexibility of the diaphragm-like hinge, and after sufficient travel, the stops 48 and 50 are no longer aligned with each other and will not engage each other when the valve lever is depressed. Because of the beveled surfaces on the respective stops, the valve lever is permitted to move downwardly with facility in order to effect discharge of the contents of the aerosol can. Upon release of the valve lever and removal of the cap from the firm surface, the cone 32 returns to its rest position.

It should be observed that the cap 32 shown in FIGS. 8 and 9 does not have venting holes as seen in the cap 12 of FIG. 1. However, venting is accomplished by means of openings in the valve assembly as seen by the arrow X in FIG. 9.

FIGS. 11 and 12 show details of construction of the swivel valve arrangement having the spout 22 which can pivot upwardly. An outlet channel 56 is shown, as well as a venting channel 58. The spout is adapted to swivel on pivot pins 22*a*. Thus, the nozzle assembly can be moved from a normal position generally perpendicular to the axis of the can 10 to a position which is generally co-axially therewith.

It must be apparent that the present safety feature prevents flammable propellents from being accidentally discharged in an area where a flame or other ignition source is present, and confines the discharge of the contents of the aerosol can to an area within the cap only.

What I claim is:

1. In an insect exterminating device, an aerosol can having a liquid propellent, a rotatable valve assembly having a valve lever connected to a valve supply tube, the latter having its free end submerged in said liquid propellent, the invention comprising: a discharge orifice for said liquid propellent having an enlarged part at the forward end thereof provided with a flat edge that can be placed against a flat surface such as a wall to form an enclosure trapping an insect therein, means for venting said enlarged part, a mounting fixture inserted on the top of said can having said valve lever movably secured thereto, a connecting member connecting said enclosure to said mounting fixture, said connecting member having a flexible part, said valve lever and connecting member respectively provided with aligned abutments in the inactive condition of said device so that the valve lever cannot be depressed to discharge a quantity of liquid propellent, and when said enclosure is pressed firmly against a flat surface said flexible part is caused to flex whereby said enclosure is forced inwardly, and said abutments are caused to be moved out of alignment thereby permitting the valve lever to be depressed to release a quantity of liquid propellent through said orifice which upon sudden expansion forms a cold gas that freezes said insect within said enclosure.

2. An insect exterminating device as claimed in claim 5 wherein said flexible part is a diaphragm-like hinge.

3. An insect exterminating device as claimed in claim 1 wherein each of said abutments are provided with bevelled surfaces that engage each other when said valve lever moves downwardly.

4. An insect exterminating device as claimed in claim 1 further comprising a child safety means including a ring-like fitting on said valve assembly being constructed and arranged to block the downward movement of said valve lever unless said valve assembly is rotated to a predetermined position before depression of said valve lever.

* * * * *